US005398678A

United States Patent [19]

Gamow

[11] Patent Number: 5,398,678

[45] **Date of Patent: * Mar. 21, 1995**

[54] HYPERBARIC CHAMBER AND EXERCISE ENVIRONMENT

[75] Inventor: Rustem I. Gamow, Boulder, Colo.

[73] Assignee: Portable Hyperbarics, Inc., Ilion, N.Y.

[ * ] Notice: The portion of the term of this patent subsequent to May 15, 2007 has been disclaimed.

[21] Appl. No.: 77,325

[22] Filed: Jun. 14, 1993

Related U.S. Application Data

[63] Continuation of Ser. No. 690,634, Apr. 24, 1991, abandoned, which is a continuation-in-part of Ser. No. 341,645, Apr. 21, 1989, Pat. No. 5,109,837, which is a continuation-in-part of Ser. No. 10,046, Feb. 2, 1987, Pat. No. 4,974,829, which is a continuation-in-part of Ser. No. 743,011, Jun. 10, 1985, abandoned.

[51] Int. Cl.[6] ..... A61G 10/02

[52] U.S. Cl. ..... 128/205.26; 128/202.12

[58] Field of Search ..... 128/200.24, 202.12, 128/205.26; 600/21, 22; 482/13, 148

[56] References Cited

U.S. PATENT DOCUMENTS

| | | | |
|---|---|---|---|
| 2,401,230 | 5/1946 | Colley | 128/202.12 |
| 2,731,055 | 1/1956 | Smith | 150/52 |
| 3,768,467 | 10/1973 | Jennings | 128/202.12 |
| 3,801,093 | 4/1974 | Jones, III | 272/3 |
| 3,991,583 | 11/1976 | Scurlock | 128/205.26 |
| 4,106,504 | 8/1978 | York | 128/205.26 |
| 4,196,656 | 4/1980 | Wallace et al. | 98/1.5 |
| 4,407,723 | 10/1983 | MacGregor et al. | 128/201.25 |
| 4,974,829 | 12/1990 | Gamow et al. | 128/205.26 |
| 5,109,837 | 5/1992 | Gamow | 128/202.12 |

FOREIGN PATENT DOCUMENTS

| | | | |
|---|---|---|---|
| 3004156 | 6/1981 | Germany | 128/202.12 |
| 1200563 | 7/1970 | United Kingdom | 128/202.12 |

OTHER PUBLICATIONS

Williams Apr. 22, 1985 *Boulder Daily Camera.*

Gamow et al. (1990) J. Wilderness Medicine 1:165–180.

King (1990) J. Wilderness Medicine 1:193–202.

Tabor et al. (1990) J. Wilderness Medicine 1:181–192.

Altitude Adjustments in the Apr. 30, 1987 *Daily Camera* pp. 1B–2B.

Levine et al. (1991) Med. Sci. in Sports and Exercise 23(4):suppl abstract #145.

*Primary Examiner*—Kimberly L. Asher

*Attorney, Agent, or Firm*—Greenlee and Winner

[57] ABSTRACT

A portable hyperbaric chamber is provided that allows a person to perform endurance exercise at barometric pressures of from 0 to 10 lbs./square inch greater than ambient. The chamber is portable, semi-spherical and inexpensively constructed of an essentially air-impermeable, flexible material. The chamber is used for endurance conditioning, to improve the athletic performance of people who live at altitudes above sea level.

4 Claims, 6 Drawing Sheets

HYPERBARIC CHAMBER AND EXERCISE ENVIRONMENT

This is a continuation of copending application Ser. No. 07/690,634, filed on Apr. 24, 1994, now abandoned; which is a continuation-in-part of copending U.S. application Ser. No. 07/341,645, filed Apr. 21, 1989, now U.S. Pat. No. 5,109 837, which is a continuation-in-part of U.S. application Ser. No. 07/010,046 filed Feb. 2, 1987, issued Dec. 4, 1990 as U.S. Pat. No. 4,974,829, which is a continuation-in-part of U.S. application Ser. No. 06/743,011, filed Jun. 10, 1985, now abandoned.

INTRODUCTION AND BACKGROUND

As man roams the globe, from climbing high mountains to exploring ocean depths, increasing instances occur of detrimental effects of acute or chronic exposure to altitude or to reduced ambient pressure. A variety of acute, subacute and chronic conditions related to brief or prolonged exposure to altitude (or to decompression, in the case of divers and others working at elevated pressure) are nevertheless alleviated by treatment in a hyperbaric atmosphere. (The term "hyperbaric" is used herein to mean a pressure greater than ambient, over and above the range of pressure variation encountered in the course of normal fluctuations in atmospheric pressure caused by changes in the weather.)

It is well-known that humans ascending to altitude may experience a variety of symptoms collectively known as "mountain sickness." The symptoms of mountain sickness are especially prevalent with people coming from sea level to ski at ski resorts 2000 meters and higher above sea level. In general, these symptoms are not severe and after a few days of nausea and headache the symptoms go away. Nevertheless, some individuals are dreadfully sick even at these low altitudes, and it would be beneficial to get them to a higher barometric pressure as soon as possible.

On the other hand, severe mountain sickness which includes the following diseases: acute mountain sickness, high altitude pulmonary edema, Monge's disease and Brisket disease, are of major concern of mountaineers. The problems for mountaineers are of course very much greater than for the recreational skier. First, the altitudes may be very much greater, approaching 10,000 meters, and the physical condition of the climbers themselves is greatly weakened not only from the altitude but from the long-term exposure to extreme elements. All life supporting systems must be carried by foot and be contained in backpacks. To date, if a climber becomes severely ill because of the altitude the only treatment is to get him or her to as low an elevation as possible as soon as possible. This is often not done because weather and terrain conditions may trap the climbers for days, if not weeks.

A second problem that mountaineers experience at altitude is the inability to maintain a regular sleep cycle. This problem is more severe for some climbers than others, but it is a problem for every high altitude climber.

In addition to detrimental effects which may be hazardous to health, changes in altitude are known to affect athletic performance. It is well-known that persons who normally live at or near sea level experience such symptoms as shortness of breath and dizziness when they travel to high altitudes. The symptoms usually wear off in one to two weeks. Such experiences have been explained as being the result of reduced ambient oxygen tension in high altitude air (See Abstracts, International Symposium on the Effects of Altitude on Physical Performance, Mar. 3–6, 1986, Albuquerque, N. Mex.). Initial acclimatization has been shown to be accompanied by an increase in circulating red blood cells presumably put into circulation to enhance the blood's oxygen-carrying capacity (Ibid.). Full acclimatization is achieved after 2–3 months, and is accompanied by an increased hematocrit.

It has been recommended (Castro, R., "Altitude Offers Big Training Advantage," *Boulder Daily Camera*, Sep. 14, 1978) that athletes engaged in sports such as running, cycling and the like, where a high level of cardiovascular output is required, should train at altitudes. It is generally accepted by athletes that altitude training is beneficial (see Williams, K., "Boulder is Training Haven for Runners," *Boulder Daily Camera*, Apr. 22, 1985). The recommendation is based on the rationale that the normal acclimatization to altitude will generally improve cardiovascular efficiency, and hence athletic performance.

Practical application of the foregoing rationale has not been demonstrably successful. Many athletes trained at altitude prior to competing in the 1968 Olympics, held in Mexico City (7,500 feet). Even with this altitude training, no new records in track endurance events were set that year (Daniels, J. and Oldridge, N. (1970) "The effects of altitude exposure to altitude and sea level on world class middle distance runners" in *Medicine and Science in Sports*, Vol. 2, No. 3, pp. 107–112). Recently evidence has been reported that casts doubt on the notion that athletes who have lived and trained at altitude would have an advantage in terms of performing endurance events at altitude or near sea level (Grover, R. F. et al. (1976) Circulation Res. 38:391–3). Grover has shown that the total volume of blood declines by as much as 25 percent as the body responds to high altitude. This decrease in blood volume causes an increase in blood viscosity that, in turn, causes the heart to decrease the amount of blood pumped. Since endurance athletic performance is thought to be dependent on the amount of oxygen in the blood, a decrease in blood volume might result in a decrease in athletic performance. This decrease in plasma volume results in the well-known phenomenon of measuring an increase in red blood cell concentration (hematocrit) as a result of acclimatization to altitude. Doctors who work in the field of sport medicine have long known that athletes have a condition known as sports anemia (Pate, R. R. (1983) "Sports Anemia: A Review of the Current Research Literature" in *The Physician and Sports Medicine*, Vol. II, No. 2). They appear to have fewer red blood cells, but in reality they have an increase in plasma volume. One interpretation is that this increase in plasma volume allows the heart to perform to its maximum ability, thereby increasing athletic performance.

The present invention provides a unique device, a portable hyperbaric chamber, adapted in various ways to provide a temporary environment of elevated pressure. The device is described with respect to specific adaptations thereof, in order to demonstrate certain new uses, not heretofore available. In one embodiment, the device serves as an exercise environment, permitting an improved endurance training regimen. In another embodiment, the device is adapted for the emergency treatment of "mountain sickness" or acute pulmonary edema. The disclosed uses are novel, no previous device being available to perform the functions of the device of the present invention.

While not based upon any specific theory or hypothesis, the present invention provides in one embodiment a novel and unobvious method of endurance conditioning and apparatus for carrying out such a method which is consistent with the foregoing observations. This embodiment of the invention is based on the premise that, contrary to the widely held view that endurance training at altitude is beneficial to athletic performance, the opposite is in fact the case: athletic performance in endurance-type events is improved at all altitudes by undertaking the training exercises at an atmospheric pressure equal to, or even greater than, the normal pressure at sea level. The benefit of training at such pressures is obtainable by persons living at altitude, provided the training exercises are carried out at sea level or greater than sea level pressures. The invention includes the design and construction of a hyperbaric chamber that would allow an athlete living at altitude to train at or below sea level, either in his or her own home or in an athletic club.

Another embodiment of the invention described herein provides a unique solution to the alleviation of mountain sickness, pulmonary edema and sleep cycle disruption due to altitude by providing a portable hyperbaric chamber which can be folded or collapsed and carried in a backpack, to be deployed as needed to simulate a lower altitude for a climber suffering mountain sickness without moving the climber to a lower altitude.

Hyperbaric chambers of the prior art have been heavy, rigid structures, permanently installed. Any structure of rectilinear design must be constructed of extremely strong and heavy materials, even to maintain 10 pounds per square inch pressure greater than ambient. Structures with such design are permanently installed. Cylindrical chambers large enough to admit a human being and allow movement within the chamber have been disclosed (see, e.g., Wallace et al. U.S. Pat. No. 4,196,656), but such structures are not truly portable, which term is used herein to mean capable of being dismantled, packaged and carried by an individual person. Air-supported structures, tennis domes, radomes and the like are distinguished from the devices of the present invention by the fact that only a minuscule increment of pressure is needed to maintain such structures in an inflated condition. For example, a pressure differential of only 70 mm water pressure is all that is required to maintain the rigidity of a radar dome of 15 meter diameter in winds up to 240 mph. In units of psi, 70 mm of water is approximately 0.1 lb/sq. inch, an amount within the range of normal atmospheric fluctuations due to weather conditions and not hyperbaric as herein defined. Examples of air-supported, but nonhyperbaric structures are shown by Dent, R. M., *Principles of Pneumatic Architecture* (1972), John Wiley & Sons, Inc., New York; by Riordan, U.S. Pat. No. 4,103,369; and by Jones III, U.S. Pat. No. 3,801,093. Hyperbaric chambers of this invention are described in the following articles published after the priority filing date hereof, which articles are hereby incorporated herein by reference: R. I Gamow et al. (1990) "Methods of gas-balance control to be used with a portable hyperbaric chamber in the treatment of high altitude illness," J. Wilderness Medicine 1:165–180; S. J. King and R. R. Greenlee (1990), "Successful use of the Gamow Hyperbaric Bag in the treatment of altitude illness at Mount Everest," J. Wilderness Medicine 1:193–202; and R. L. Taber (1990), "Protocols for the use of a portable hyperbaric chamber for the treatment of high altitude disorders," J. wilderness Medicine 1:181–192.

SUMMARY OF THE INVENTION

The device of the present invention is designed to provide a portable, compact hyperbaric enclosure for temporary use by a human being or other terrestrial mammal for a beneficial health-related effect. Embodiments of the device are adapted to achieve specific beneficial effects, including, as exemplified herein, relief from altitude sickness, pulmonary edema, rapid decompression, and improved endurance conditioning for athletes training at altitude. The shapes and sizes of such embodiments vary according to their specific use For example, an embodiment designed to provide a hyperbaric environment for a climber suffering from altitude sickness need not be much larger than a sleeping bag, while a device for exercise training must be large enough to permit a range of movements or to contain a desired exercise device such as an exercise bicycle, rowing machine or the like. All embodiments nevertheless present common features of construction such as spherical or near-spherical sides along at least one axis of symmetry, construction of nonbreathable, preferably flexible material, means for achieving and maintaining air (or other gas mixture) pressure inside the chamber adjustable from 0–10 lbs. per square inch greater than ambient, and preferably 0.2–10 lbs per square inch greater than ambient, and means for ingress and egress which can be closed to prevent air loss. Alternative devices have means for achieving and maintaining air or other gas mixture pressure inside the chamber from 0.2 psi to 10 psi greater than ambient and in preferred embodiments the pressure is achieved and maintained in the range from 0.2 psi to 4 psi above ambient.

The embodiment used for exercise training is referred to herein as the exerciser. One embodiment of the exerciser is an eight foot in diameter spherical chamber, made of a nonbreathable fabric that can be inflated to hyperbaric pressure using air pumping means such as a portable air compressor. The air can be continuously circulated in the sphere by simultaneously controlling the internal pressure by means of an inlet valve and an exhaust valve. Within the exerciser there can be any desired stationary exercising units such as a bike or a treadmill. The entire sphere can be designed to be portable, aesthetically pleasing, and to include windows to avoid any closed-in feeling. Optionally, instruments could be added to the exerciser such as a barometer, and devices to measure heart rate, breathing rate or body temperature.

The exerciser is then used for endurance conditioning by carrying out the exercise routines which comprise the athlete's training regimen within the exerciser at sea level barometric pressure or greater. Maximum benefit will be obtained by exercising daily within the exerciser for a period sufficient to elicit maximum cardiopulmonary performance. By using the exerciser in this manner, the athlete achieves the equivalent benefit of training at sea level, even though the majority of his or her waking hours is lived at a higher elevation. Even better performance can be achieved by carrying out the exercise program at a barometric pressure greater than sea level.

We disclose herein a portable hyperbaric chamber designed for athletes who live at altitude but would like to be able to perform endurance training at sea level atmospheric pressure, or below sea level. The hyperbaric exerciser is advantageous for several uses:

1. For athletes who live at altitude but wish to train at sea level in order to enhance their athletic performance.
2. For future experimentation using either animals or human subjects to determine whether training at below sea level atmospheric pressure would further enhance athletic performance above that achieved at sea level.

Also disclosed herein is a second hyperbaric exercise environment for use under water or submerged in any suitable liquid. This invention is designed for use at lung depths between about 4 feet and about 15 feet. At such depths, the atmospheric pressure is increased to allow more efficient athletic and fitness training, including cardiovascular training.

In a recent presentation at the Seventh International Hypoxia Symposium held at Lake Louise, Alberta, Canada on Mar. 2, 1991, by Drs. Ben Levine and Charles Houston, entitled "Benefits of Training at High Altitude, Myth or Reality," conclusive data was presented showing the advantages of hyperbaric athletic training. No abstract or publication memorializing this presentation has yet been published.

The concept of underwater hyperbaric exercise was discussed in an article published after the priority date hereof entitled "Altitude Adjustments" in the Apr. 30, 1987 *Daily Camera*, pages 1B–2B. The article discusses experiments by Dr. Igor Gamow, the inventor hereof, testing the effects of depths up to 13' (equivalent to 6,000 feet below sea level) on an exerciser's heart rate using a rowing machine and standard scuba equipment. The experiments showed a decrease with depth in heart rate of the exerciser while performing the same amount of work.

Because of the awkwardness, discomfort, expense, and need for specialized training for the use of scuba gear, it was desired to provide an exercise environment whereby a person could exercise under water, or submerged in another suitable fluid, without the necessity for a face mask or scuba gear.

To this end, the present invention provides a submersible breathing bowl capable of holding at least about a minimum of one-fifth to one-half cubic feet of oxygen-containing gas, preferably air, at a pressure between about 2 and about 7 psi.

The breathing bowl may be large enough to cover only the exerciser's head, like a diving helmet, or preferably is at least twice the size of the exerciser's head. It may be large enough to cover his or her whole body, and can be large enough to accommodate more than one exerciser's head or whole body. Preferably the bowl has a volume of between about 0.5 and about 4 cubic feet. The bowl should be large enough to provide comfortable breathing space for the exerciser. There is no theoretical upper limit to the size of the bowl; however, as the volume of the breathing bowl increases, the amount of air under pressure needed to supply the bowl increases, and thus the expense of operating the unit. The bowl may be of any shape provided it is capable of holding a volume of trapped air under the surface of the liquid.

Preferably, the bowl covers only the exerciser's head and leaves the rest of his body exposed to the water or other fluid so that the body is kept cool while exercising.

It should be understood that while the preferred embodiment of this invention involves the use of a water environment, such as that of a swimming pool or pond of suitable depth, other liquids may also be used, including liquids of more or less density than water, such as salt water, and fluids of increased viscosity to provide additional exercise benefits of overcoming the resistance of the surrounding fluid.

The liquid in which the breathing bowl is submerged should have a depth of at least about 6 to about 20 feet to maintain the diver's lungs at a preferred depth of between about 4 and about 15 feet.

Preferably the liquid is kept at a cool temperature to prevent overheating of the exerciser's body and enhance physical performance, although higher or lower temperatures may also be used as preferred by the user. Normal swimming pool temperatures of around 70°–85° F. are preferred, more preferably in the range of 70°–80° F.

Unless the bowl is of a sufficiently large size to accommodate enough air for the exerciser for the entire exercise period, a continuous stream of air or other oxygen-containing gas under pressure should be supplied to the breathing bowl. As is known to the art, pure oxygen is toxic above certain pressures, and such toxic conditions should be avoided. The gas may be of any composition which supports life, and may additionally contain medicinal or other substances to affect the exerciser's physiology. As is known in the art, an exerciser requires approximately 20 l (about ¾ cu. ft.) to 200 l (about 7 cu. ft.) of fresh air per minute. A closed volume of at least about 4 cubic feet would be required to allow an exerciser who was an average-size male weighing about 70 kilograms to stay comfortably submerged for a period of about 30 minutes.

As is well understood by those skilled in the art, the air must be supplied at a pressure substantially equivalent to the water pressure at the depth the breathing bowl is submerged. Any means known to the art may be used to supply air to the breathing bowl, e.g., compressed air tanks, motor-driven compressors, or hand or foot pumps. In a preferred embodiment, the air is supplied via a pressurized reservoir bag such as the SUBA device described in U.S. patent application Ser. No. 07/624,141, which is incorporated herein by reference. As is understood by the skilled worker, if too little pressure is used, the air will fail to fill the bowl; and if too much pressure is used, air will flow out from under the sides of the bowl and be wasted.

In a preferred embodiment, the bowl is equipped with outlet means for the air supply as well as inlet means. If no outlet means are provided, air bubbling out from under the sides of the bowl may cause disturbing audial and visual effects for the exerciser.

Means are supplied for maintaining the breathing bowl in proper position to allow breathing by the exerciser. The bowl may be attached to exercise equipment used by the exerciser or to the sides or bottom of the pool providing the exercise environment, or to overhead supports such as floats on the surface of the pool. Alternatively, the bowl may be attached to the exerciser by means of straps or other suitable attachments to allow for more freedom of movement.

The exercise environment may also include exercise equipment such as rowing machines, ski machines, stationary bicycles, treadmills and the like as known to the art. Preferably the exercise equipment allows the exerciser to stay in a fairly stationary position with respect to the pool and the breathing bowl. Such equipment is preferably equipped with straps to keep the exerciser from floating to the surface of the pool. Alternatively, the exerciser may wear weights, such as those used by divers, to remain submerged.

In a preferred embodiment, at least one portion of the breathing bowl is transparent to allow the exerciser to see out of the bowl. This transparent portion may be a window, or an entire side of the bowl; or the complete bowl may be transparent.

At least a portion of the structure containing the liquid providing the exercise environment may also be transparent to allow others such as trainers, coaches, and interested parties, to view the exerciser at work.

An embodiment of this invention used for alleviating mountain sickness and pulmonary edema will be referred to herein as a hyperbaric mountain bubble.

A hyperbaric mountain bubble is constructed of a flexible, nonbreathable fabric capable of retaining air at a pressure of from about 0.2 psi to about 10 psi gauge, large enough to enclose a human being. The bubble has means for ingress and egress which may be closed to provide an essentially air-tight seal. Means for inflating the bubble and achieving an elevated pressure of from about 0.2 psi to about 10 psi gauge and valve means for controlling air pressure are provided. Optionally, means for scavenging excess moisture and carbon dioxide from the interior may be provided, although such devices need not be integral to the bubble.

The bubble is preferably constructed in a spherical, semispherical or "sausage" shape (cylindrical with hemispherical ends). The bubble may be fully self-supporting or it may have flexible wands or other means for extending the structure to an ambient pressure-inflated condition before being pressurized.

The bubble can be used for any condition of mountain sickness, sleep cycle disruption or pulmonary edema, where a decreased altitude (or increased ambient air pressure) is desired. Each pound per square inch of pressure above ambient corresponds approximately to a decrease of 2,000 feet altitude. The affected individual is placed within the bubble, the entrance sealed and the bubble is then pressurized to the desired pressure, which will vary, depending on the elevation and severity of symptoms. Frequently it is found that a descent of 2,000–4,000 feet provides relief; therefore, 1–2 pounds per square inch gauge of hyperbaric pressure will be adequate in many cases.

The bubble is also useful when a hyperbaric environment is required at low altitudes, such as by divers who require a pressurized environment to control the effects of rapid surfacing.

Essential features of the bubble for its intended use are that it be lightweight, portable, compactly foldable when not in use, and above all, capable of retaining an internal air pressure of at least greater than 0.2 psi gauge and preferably up to 4–5 psi gauge, although embodiments capable of retaining up to 10 psi gauge are described herein.

Another embodiment of this invention is a closed circuit rebreather which includes the use of an oxygen source and carbon dioxide removal means. This allows the invention to be used without continuous pumping or other attention for a period of hours. This embodiment also allows the chamber to be supplied by means of oxygen containers rather than compressed-air containers which would be less efficient to carry into mountain or other wilderness environments. Compressed air containers would not be useful for this embodiment.

This embodiment may be described as a substantially leak-proof rebreather made of nonbreathable material capable of maintaining air pressures in the range from about atmospheric to 0–10 psi greater than ambient, and preferably from about 0.2 to about 10, or more preferably from about 0.2 to about 4.0 psi greater than ambient, comprising carbon dioxide removal means, preferably lithium hydroxide pads inside said chamber, and oxygen input means responsive to drops in pressure below a preselected pressure in said pressure range, preferably about 2.0 psi greater than ambient, resulting from said carbon dioxide removal, to maintain said preselected pressure by oxygen input.

"Substantially leak-proof" as used herein means a leak rate less than about 0.4 l/min, preferably no more than about 0.22 l/min.

"Rebreather" means an embodiment of this invention which is large enough to hold a sufficient volume of air for a human to breathe during a period of time sufficient for an attendant to take care of necessary maintenance tasks other than air maintenance, preferably one-half hour or more. The rebreather must be substantially leak proof, and is large enough to contain a whole human body.

This closed-circuit breathing system supplies air, preferably not oxygen-enriched, at whatever pressure desired, for periods of time (preferably at least about six hours) depending on the amount of oxygen in the oxygen source and the capacity of the carbon dioxide removal means. This embodiment also dispenses with the need for constant monitoring and adjustment of oxygen flow. It is used preferably in mountain environments, but may also be used in any environment where an extended period must be spent in an enclosed space, such as underground or under water. In such environments, the preferred pressure to be maintained within the bubble is atmospheric pressure.

In this embodiment, an oxygen source, preferably a container of compressed oxygen, is connected to the interior of the chamber through a pressure regulator such that oxygen is bled into the chamber in response to a pressure drop below a preselected pressure. For most mountain applications, the preferred pressure is about 2 psi above ambient. As the air inside the chamber is breathed, oxygen is converted to carbon dioxide and exhaled into the chamber. The carbon dioxide is then removed by the carbon dioxide removal means inside the chamber, preferably scrubber pads such as the lithium hydroxide scrubbers provided by DuPont. Removal of the carbon dioxide results in a pressure drop which activates the pressure regulator to bleed additional oxygen into the chamber. In this way, oxygen is added to the chamber only in amounts required to replace oxygen converted to carbon dioxide by breathing, and the original gas composition of the air is maintained. The original gas composition inside the chamber can be any breathable mixture, including an enriched oxygen mixture, but is preferably normal air composition.

A further embodiment of this invention is a portable high altitude habitat capable of hyperbaric pressurization.

"High altitude habitat" means an embodiment of this invention suitable for use as a mountain tent in both its pressurized and unpressurized conditions. Preferably it is large enough to allow at least one person, and preferably two, to sit upright, sleep, and perform ordinary functions such as dressing and food preparation, and preferably has a volume of at least about 35–45 cu. ft.

This embodiment is described as a portable high altitude habitat comprising spherical or near spherical sides along at least one axis of symmetry, made of flexible, nonbreathable material capable of maintaining air pressures in the range from 0–10 psi greater than ambient comprising rigid means for supporting said flexible material, means for achieving and adjusting air pressure inside the chamber adjustable from 0–10 psi greater than ambient, and comprising an airtight zipper for ingress and egress of an inhabitant disposed in said spherical sides perpendicular to said axis of symmetry.

"Rigid means" for support the high altitude habitat include tent wands, poles, internal frames, and air tubes or any material capable of supporting the weight of the habitat to enclose a volume of unpressured air. In a preferred embodiment, the habitat is equipped with external air tubes which may be blown up by mouth through mouthpieces attached to each tube.

It is important that the zipper be placed perpendicular to the axis of symmetry as shown in FIG. 7, as a chamber as large as a tent places greater stresses on the zipper along the axis of symmetry than perpendicular to this axis, and depending on the strength of the zipper, these stresses may be sufficient to break the zipper.

The zipper in the preferred embodiment includes a sleeve construction as shown in FIG. 8. A cylindrical sleeve of fabric or other flexible material which is impermeable to air is attached, e.g., by sewing or heat sealing, at one end to the inside of the chamber around the outer perimeter of the zipper. To gain access to the chamber, the sleeve is pulled to the outside of the chamber through the zipper opening allowing ingress to and egress from the chamber through the sleeve. When it is desired to close the zipper from the outside, the sleeve is folded or rolled and inserted through the zipper opening into the interior of the chamber, and the zipper is then zipped shut. When it is desired to close the zipper from the inside, the sleeve is pulled inside the chamber, the zipper is closed by reaching into the sleeve, and the sleeve is then rolled or folded to prevent air escape.

When the sleeve is in rolled or folded position, the small amount of air trapped inside the sleeve leaks through the zipper, creating a low-pressure region between the folded sleeve and the zipper which enhances the sealing of the sleeve against the zipper.

This construction substantially prevents leakage of gas from the pressurized chamber by isolating the stress-bearing function of the zipper from the air-containing function.

The exerciser embodiment is intended to achieve the following goals: to provide a portable structure of light weight, capable of maintaining in its interior an elevated pressure of up to 10 lbs./sq. in. above ambient, to provide sufficient interior volume to permit a human being to carry out fitness training using stationary equipment, to provide a design capable of being executed at a cost commensurate with other items of exercise equipment, and to provide an exercise method for athletes desiring maximal endurance conditioning. The invention is advantageous compared to designs incorporating pressurized helmets, pressure suits and the like, since such devices are cumbersome, awkward and heavy, and interfere with normal freedom of movement required for effective exercise.

The mountain bubble embodiment achieves the following goals: to provide a portable structure of light weight capable of maintaining in its interior an elevated pressure of up to 10 psi above ambient, to provide sufficient interior volume to permit a human being to sleep within a sleeping bag, to provide a design capable of being executed at a cost commensurate with other mountain survival equipment, to provide a living space for mountaineers suffering from high altitude sickness or who have altitude-related sleeping problems.

The closed-circuit rebreather achieves the following goal: to provide and maintain a breathable air supply in a closed environment, preferably pressurized, for a period of at least several hours without the necessity for pumping, or carrying compressed air canisters, in a pressurized or non-pressurized environment.

The mountain bubble using the bladder achieves the following goal: to provide a breathable air supply within a pressurized environment without the necessity for continuous pumping or the necessity to carry oxygen to maintain a breathable oxygen concentration.

The hydrobaric exerciser (underwater exercise environment) achieves the following goal: to allow an exerciser to exercise at pressures below ambient, e.g., sea level atmospheric pressures or lower, to increase the cardiovascular benefits, muscular development and general overall fitness and athletic ability attainable through exercise in a shorter period of time than the same exercise at ambient atmospheric pressure.

GENERAL FEATURES OF HYPERBARIC CHAMBERS OF THE INVENTION

Figures 1, 2, 3, 4:
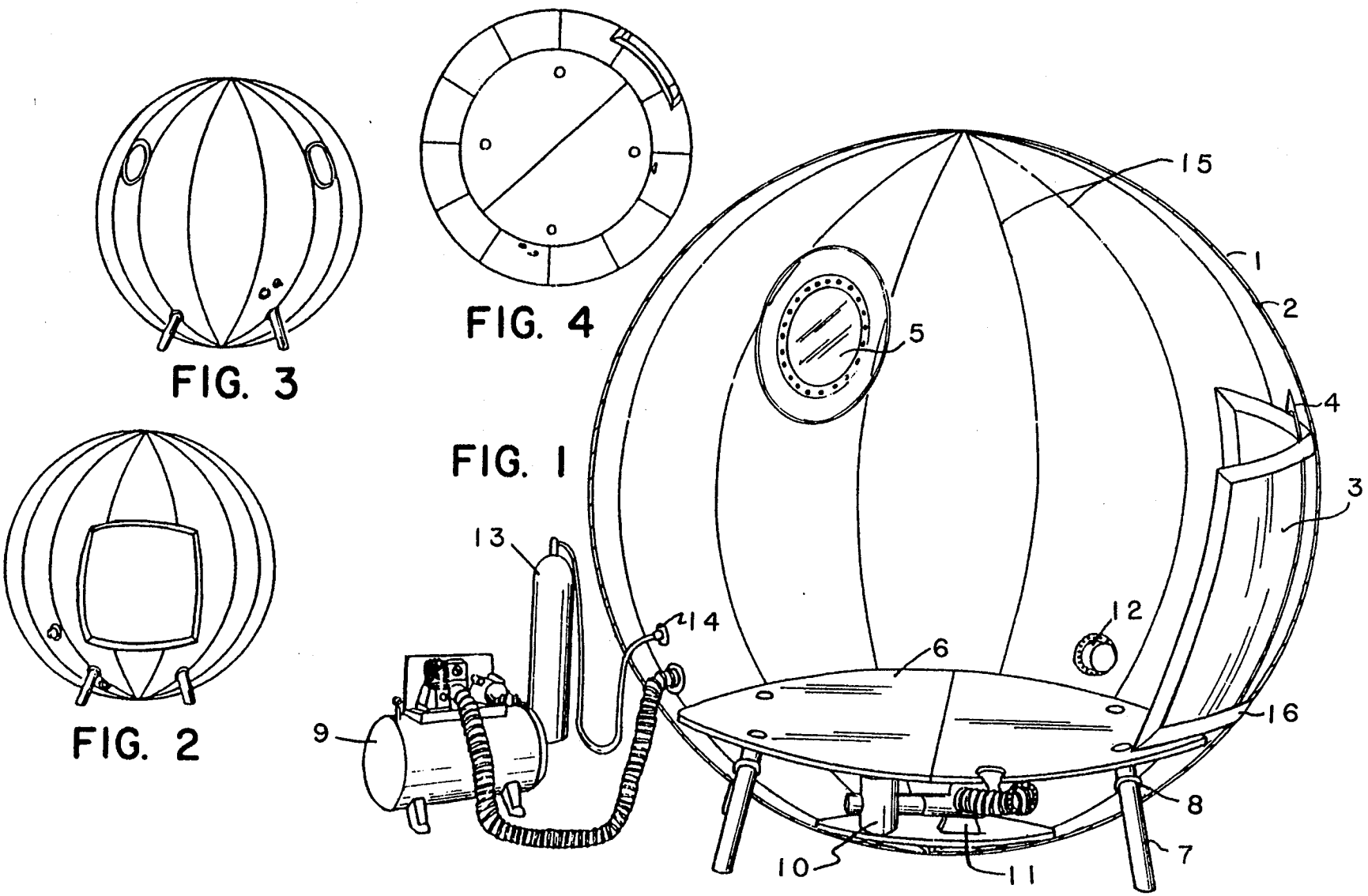
FIG. 1 is a cutaway view of a hyperbaric exerciser embodiment of the invention showing the principal components diagrammatically.
FIGS. 2, 3 and 4 are exterior views of a hyperbaric exerciser, drawn to reduced scale relative to FIG. 1, showing "front," "back" and "top" views, respectively. The top view is actually a cutaway view to show an internal platform and its relative dimensions.

The various embodiments herein described, as well as other embodiments constructed according to the teachings herein, have many structural features in common. The devices are portable, which is defined as not intended for permanent installation, but capable of being collapsed, disassembled and moved from one location to another. The mountain bubble described herein is designed to be light and compact enough to be carried in a backpack as normal emergency equipment of a high altitude expedition. Alternatively, it can be carried in an ambulance as part of standard equipment for emergency treatment of pulmonary edema at any altitude. The material of the embodiments is flexible, defined as having flexibility characteristics similar to fabric, vinyl or leather. The material is nonbreathable, defined herein as substantially gas impermeable, at least with respect to the major gaseous components of the atmosphere.

The hyperbaric chamber devices of the invention are designed to maintain pressure from 0–10 psi above ambient. For purposes of defining pressures greater than ambient, it will be understood that any such pressure is measured above the normal background of atmospheric pressure fluctuations due to weather. Alternative devices of the invention are designed to maintain pressures from 0.2 psi to 10 psi above ambient, and preferred embodiments maintain pressures from 0.2 psi to 4 psi above ambient.

Many suitable means for introducing air or gas mixtures to achieve a desired pressure are known in the art. The choice thereof will depend on the use to be made of the device, the volume of air to be delivered and the desired rate of circulation. Other considerations, such as temperature, humidity and noise level are also significant. For the mountain bubble, and high altitude habitat where extreme portability is desired and the total air volume is small, a hand pump such as is used for bicycle tires can be used to inflate the device. Preferably, a foot pump, such as those used for inflation of rubber rafts, is used. For an exerciser, where a larger volume must be filled, an electric or gas-powered compressor can be used. Where a constant air flow at preset pressure is desired, a differential pressure gauge with an exhaust valve may be included. Other means, including supplying air or gas from a pressurized tank may be used, as will be understood by those of ordinary skill in the art. It will also be understood that positive displacement pumping means are required because fans, blowers and the like are not capable of providing the desired range of pressures.

The internal atmospheric composition can be controlled by means known to the art. As examples without any limitation of such means, known expedients for scavenging $CO_2$ and humidity may be employed, the capacity of such means being provided according to the intended use of the devices. The mountain bubble, enclosing a resting individual, can contain such $CO_2$ and humidity control as required using portable scavenging materials known in the art. The exerciser devices require larger capacities according to the needs of an exercising person. Alternatively, the exerciser can be provided with a sufficient flow of input air or gas mixture that the device is essentially continuously purged of excess $CO_2$ and humidity. Inasmuch as such means are peripheral to the basic devices, substitutions may be made as desired without the necessity of making major changes to the device itself, all within the scope of ordinary skill as presently known or later devised, according to the desired and intended function of the device.

Temperature can be controlled, where needed, by conventional means external to the devices themselves. For example, a patient in the mountain bubble can be kept warm in a sleeping bag. In the exerciser, cooling is the more likely requirement accomplished, for example, by passing input air over the cooling coils of an air conditioning unit.

The devices can be constructed of pre-cut panels of flexible, air-impermeable material, preferably nylon coated with polyurethane which is heat-sealed along the seams or radio frequency welded, vinyl, Kevlar (Trademark, DuPont Corporation, Wilmington, Del.), sewed with overlapping, flat-felled seams, sealed with heat-activated tape or preferably electrowelded. Safety may be enhanced by providing an outer shell of lightweight, strong but air-impermeable fabric, such as ripstop nylon. As is known in the art, if the inner, air-impermeable shell is sized slightly larger than the outer shell, the internal pressure will actually be supported by the outer shell. If a leak or hole should occur in the inner shell, there will not be an explosive decompression or bursting of the inner shell, but only such leakage as occurs through the hole. Further safety could be provided by encasing the structure in a lightweight netting of strong fiber, such as nylon. When an outer shell is used, the inner shell may be constructed of latex or rubber, using, for example, a weather balloon, fitted out with the necessary inlets, outlets and means for ingress and egress, as described herein. Various examples of those expedients are presented in the examples, and others, as may occur to those skilled in the art, can be used to enhance safety and longevity of the device under field conditions. It is understood in the art that the tensile strength required of the shell material increases directly as the diameter of the chamber. For example, a chamber or bubble of twice the diameter must withstand twice the tensile force at any given pressure. Larger structures therefore warrant greater safety precautions to prevent structural damage.

Optionally, a window can be provided using a segment of clear vinyl, for example, in order to admit light and reduce feelings of claustrophobia. The shape and placement of windows is a matter of choice available to those skilled in the art.

Figure 8:
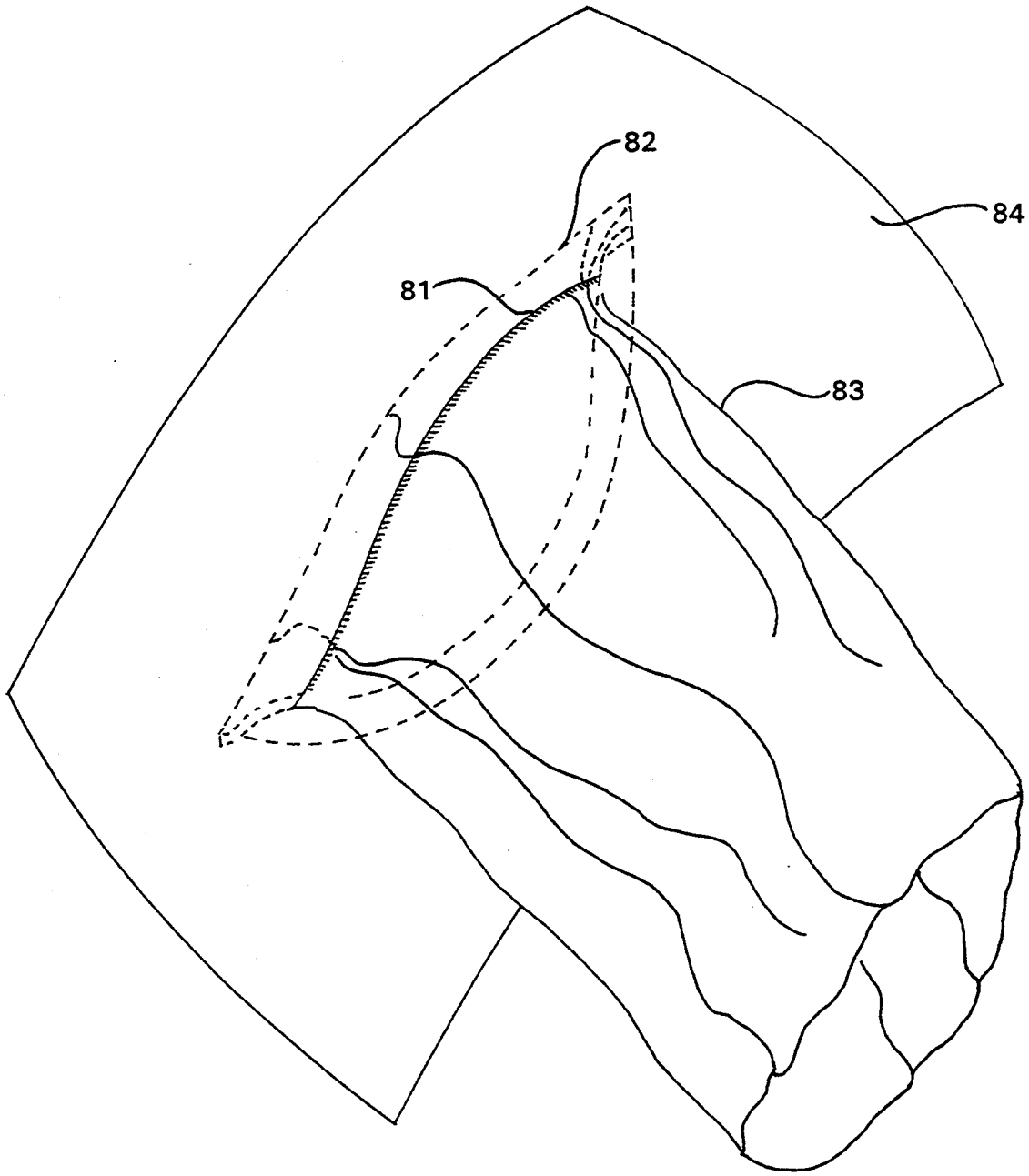
FIG. 8 shows the zipper sleeve construction used for the hyperbaric exerciser, mountain bubble and high altitude habitat of this invention.

The Talon (Meadville, Pa.) underwater zipper is a preferred means for providing ingress and egress. Other suitable airtight zippers providing the necessary strength and airtighteners may be used as known to the art. Fail-safe means for fastening the closure of ingress and egress means can also be provided. For example, the mountain bubble can be closed with lacing of hook and loop fastener strips to reinforce the air-tight zipper. Such reinforcement can be designed to be operable from inside or outside, depending upon intended use. In a preferred embodiment, the zipper is equipped with a sleeve as shown in FIG. 8. Thus the exerciser can be designed with reinforcements internally and externally operable for the convenience of the person using the exerciser. The mountain bubble can also be equipped with a reinforcement operable from outside (or from either side) to allow the patient to be assisted by others.

An exerciser embodying the features of the present invention has been constructed entirely from off-the-shelf parts. The basic material itself was 10-oz. polyester-based vinyl laminate with transparent 10 mil plastic boat windows. The entire sphere was sewn with 69 weight nylon thread and the seams were sealed with a paraffin wax-base solvent sealer. Access into the sphere was through a waterproof, airtight zipper such as is commonly used for underwater drysuits, manufactured by Talon Corporation. The sphere was pressurized by means of a commercial rotary van compressor that was oil free. The prototype exerciser was constructed using a Gast rotary compressor model #1022 that can deliver 10 cfm free air at 9 psi and maintain a positive pressure of 10 psi differential. This provided a great deal more pressure than was necessary to simulate sea level since, for example, in Denver (5,280 feet) only a 2 psi differential is required.

The sphere was constructed by sewing together the panels shown in FIG. 1, using flat felled seams. Such seams are made by sewing together the panels to be joined face-to-face, then folding the free borders of the joined pieces under and top stitching to create an airtight, stress-absorbing seam. All seams were formed in this manner, beginning in sequence from the panel adjacent to one side of the zipper tape, and proceeding to join each panel in turn, ultimately joining the last panel to the opposite side of the zipper tape. It is anticipated that radio-frequency welding, rather than sewing, will yield more air-tight seams. The floor was attached, beginning at the airtight zipper tape, sewing around the sphere, easing the floor in by lining up corresponding floor and panel sections as the sewing proceeds around the perimeter of the base. After completing the sewing, all seams were treated with a paraffin wax-base as described supra to further reduce air leakage.

Means for ingress and egress are to be provided. Such means must be capable of closure to maintain internal pressure. Examples of such means include a waterproof airtight zipper of the type used in underwater drysuits, or a zipper sleeve as described supra. Other means include a nonflexible flap panel similar to a "doggie door," designed to lay against an o-ring surrounding the opening to maintain a seal under pressure. The flap panel is preferably molded with a surface curvature conforming to the curvature of the exerciser wall. The actual radius of curvature changes slightly as the pressure is changed, so that the curvature of the flap panel is preferably set to correspond to the exerciser wall curvature that exists near the desired operating pressure.

When the exerciser is constructed of an inner shell and an outer shell, a flap door can be used in the outer shell. In that case, the opening for the door in the outer shell is provided with a frame to maintain shape and provide a frame for the door to rest against when closed. Other types of closure, as known to those skilled in the art, will be suitable.

A flat platform or floor is preferably provided for the exerciser, since the bottom of the device will be rounded at operating pressures. Legs supporting the platform can be attached through holes let in the device, the holes being sealed around the platform legs by means of o-rings or other suitable sealing means. Although the bottom of the mountain bubble is similarly rounded at operating pressures, a comfortable surface for the patient to lie upon can be provided with padding, so no special means for providing a flat bottom are needed. If desired, a piece of reinforcing fabric attached to the bottom of the bubble at longitudinal seams but not across the top and bottom may be provided. This will provide a cushion of air when the bag is pressurized.

The bubble can be free-standing, supported by its own rigidity when pressurized, or it can be supported with flexible wands, attached to the inner walls of a conventional tent or provided with inflatable ribs, all according to expedients known in the art of tent design. The problem to be overcome is that the pumping means must be compact and lightweight and therefore likely to be of limited capacity. It is therefore desirable to provide a separate way of initially filling the bubble essentially full to ambient pressure. One expedient is to provide a bubble that is dimensioned to fit within a conventional mountain tent, with ties, VELCRO TM hook and loop fasteners (Trademark Velcro Industries, NV, Willamstad, Curacao, Netherlands Antilles) or the like to attach the bubble walls to the tent walls, thereby opening the bubble and filling it with air at ambient pressure. Another embodiment includes flexible wands of, e.g., aluminum or fiberglass which can be inserted in tubes or channels to hold the bubble erect, as in conventional mountain tent design. Such a bubble could be used either free-standing as described hereinafter with reference to the high-altitude habitat of FIG. 7, or inside a conventional tent. Another expedient is to provide an inflatable shell around the bubble itself. The outer shell could be pressurized, for example, by hot air provided by a cooking stove. In the latter embodiment, an added advantage of interior warmth and insulation is provided by the outer layer. In a preferred embodiment air tubes, preferably inflatable by mouth through tubes provided for that purpose, are used to provide support for the tent.

A preferred closed-circuit rebreather of this invention uses the mountain bubble construction described herein and in U.S. Pat. No. 4,974,829, incorporated herein by reference. Without the closed-circuit breathing modification the patient is completely enclosed in the bag which is inflated and pressurized to simulate descent in altitude. $CO_2$ produced by the patient is vented from the airtight bag by means of a pressure relief valve, while fresh air is brought in from the outside via a high volume foot pump. In order to eliminate the vigorous pumping that is necessary to maintain a suitable atmosphere in the bag, the closed-circuit rebreathing provides a completely portable, self-contained life support system that supplies oxygen as it is consumed and removes the waste $CO_2$ as it is produced using lithium hydroxide pads for absorption. As pressure inside the chamber drops due to the absorption of $CO_2$, oxygen is automatically bled into the chamber under control of pressure regulator means designed to maintain homeostatic pressure inside the chamber. The entire closed-circuit rebreather, which maintains a homeostatic atmosphere in the chamber for six to eight hours, weighs less than six pounds. The chamber with the self-contained life support system weighs less than 18 pounds. It finds its greatest use in medical mountain clinics, isolated ski areas and as standard equipment for mountain search and rescue units.

A person suffering from altitude sickness can be put into the chamber and benefit from the effects of increased barometric pressure while causing virtually no added hardship on his or her companions. Physical descent down a mountain is no longer necessary with the chamber, and no gas concentration maintenance such as regular pumping is necessary with the closed-circuit breathing system. The entire set-up fits easily into a mountaineering tent, so that both the patient and the individual monitoring the patient can be sheltered from the severe weather.

The duration of treatment with no maintenance has been tested to six hours. This time period could be lengthened through use of an increased number of LiOH pads and larger or additional $O_3$ bottles as will be apparent to those skilled in the art.

As described above, the basic preferred mountain bubble or chamber is a cylindrical eight pound nylon bag that is sealed with an air-tight zipper. The bag is equipped with windows and a variety of intake and exhaust valves that allow inflation via a high performance raft foot pump to two psi gauge (103 mmHg). The chamber with foot pump weighs ten to twelve pounds, depending on the choice of pump. Laboratory tests have shown that continuous ventilation of the bag 42 liter/min, serves both to bring in fresh oxygen and vent out $CO_2$, such that the $O_2$ concentration in the chamber never drops to below 20% and $CO_2$ never reaches a 1% level (2).

Field tests done by Hackett et al. (1989) "A Portable, Fabric Hyperbaric Chamber for Treatment of High Altitude Illness," Sixth International Hypoxia Symposium, Chatteau Lake Louise, Alberta, Canada, in the summer of 1988 on Mt. Denali and by Taber and Gamow (1989) "Treatment of AMS at the HRA Clinic at Pheriche Using the "Gamow Bag" During the 1988 Fall Climbing Season," Sixth International Hypoxia Symposium, Chateau Lake Louise, Alberta, Canada, at Pheriche, Nepal, have demonstrated that when patients suffering either from severe pulmonary edema, and/or cerebral edema are subjected to a two-hour treatment in the chamber, dramatic improvement from AMS occurs. Although there is no doubt that the chamber in this present design saves lives, it suffers from two drawbacks. In order to vent the chamber properly the foot pump must be operated on the average 15 times a minute, a procedure that can exhaust even a vigorous mountaineering companion. In addition, since the foot pump is most conveniently operated from a standing position, the chamber cannot be used inside a small mountain tent with both the chamber and a person operating the foot pump inside the tent.

A solution to the problem is to equip the chamber with a small closed-circuit breathing system. A closed-circuit rebreather is a device which must both remove the $CO_2$ from the exhalant and replace the $O_2$ consumed by the patient. Such devices have been routinely used by divers, firemen and miners. Difficulties in the past have been that all these devices have been unacceptably heavy, bulky in size, and expensive. They also have had very short duration times and have all required the user to wear a face mask. The embodiment here described is a true closed-circuit rebreather that can be added to the bag and weighs less than six pounds. It is relatively inexpensive, requires no mask, and can maintain a resting person with the proper atmospheric environment (21% $O_2$ and 0.8% $CO_2$) for six hours.

To test the effectiveness of the closed-circuit rebreather of this invention, the following experiments were performed. The portable hyperbaric chamber used was manufactured by Hyperbaric Mountain Technologies, Inc., Boulder, Colo. When fully inflated, it is 2.08 m long with a diameter of 0.54 m. The internal volume is 476 liters. The chamber is constructed from polyurethane coated oxford nylon fabric. Four windows 10 cm square of 2 mm thick clear vinyl are located at the head of the chamber, to allow observation of the patient at all times.

In order to maintain a constant internal pressure, the chamber has two 2 psi pressure relief valves. The chamber was initially pressurized with a bellows type raft pump. When it is used in the non-closed circuit mode, the chamber is ventilated by pumping 10 to 15 times per minute. The $CO_2$ scrubber is made by and supplied by DuPont Company. The scrubber consists of a series of one foot square pads that have been impregnated with LiOH. One pad has been determined to last on the order of 20 minutes. The pads function not only to remove the $CO_2$ but also the accumulated moisture. A Matheson, model 8-2, pressure regulator, full scale range 0 to 3 psi, was used to both maintain chamber pressure and to also replace the spent oxygen.

Although the Matheson is an ideal pressure regulator for the laboratory experiment, in real field use a light 0.39 kg pressure regulator produced by Circle Seal Controls (Anaheim, Calif.), is preferably used. The oxygen bottle contains 136 liters when pressurized to 1750 psi. This amount will supply enough $O_2$ for a person at rest for six hours. For field use, the $O_2$ bottles can be filled to 3000 psi, thus significantly extending the duration of the oxygen supply. The concentration of $CO_2$ and $O_2$ were determined using a Hewlett Packard Patient Gas Monitor, model 78386A.

In testing the closed-circuit breathing system to be used with the mountain bubble, a series of preliminary tests were done to demonstrate the effectiveness of each component of the system.

The first test consisted of measuring the leak rate of the hyperbaric bag. It is necessary to use a chamber with a negligible leak rate to ensure a constant balance of gases; that is, the system has to be truly closed. The leak rate was determined by fully inflating the chamber (to 2 psi gauge), then taking periodic readings from the external pressure gauge.

Leak rates were calculated as follows:

Using the ideal gas law approximation, one finds that the amount of air pumped into or leaked out of the chamber versus the gauge pressure on the bag is given by $$\frac{dV}{dP} = \frac{V}{P_{AM}} \tag{1}$$

where:

dV = volume of air (at ambient pressure) pumped in or leaked out;

P = pressure on gauge;

V = volume of bag (476 l);

$P_{AM}$ = ambient pressure;
= 640 mmHg in Boulder, CO
= 760 mmHg at sea level

This equation gives a result of 0.744 l/mmHg in Boulder, Co. where the experiment was performed, and 0.626 l/mmHg at sea level. Leakage was measured directly in mmHg per unit time. Combining these measured values with equation (1) gives the leak rate in l/min.

$$\frac{dV}{dP_g}\ \frac{dP_g}{dt} = \frac{dV}{dt} \tag{2}$$

The value obtained for the chamber under study was:

$$(0.744)\ \frac{(9\ \text{mmHg})}{30\ \text{min}} = 0.22\ \text{l/min}$$

It was hoped that this leak rate would prove to be negligible. A non-negligible leak rate would be evident as an oxygen buildup in the fully integrated system.

The second phase of testing involved measuring the kinetics of the $CO_2$ absorption portion of the system. $CO_2$ from gas cylinder was bled into the chamber via a flow regulator. The flow regulator was set to deliver either 0.3 l/min or 0.5 l/min. Ten LiOH pads were suspended in the chamber. The $CO_2$ concentration remained below about 1% until the pads' absorptive capacities were exhausted. After about 120 minutes at 0.5 l/m and about 180 minutes at 0.3 l/m, the percent $CO_2$ began to rise rapidly from less than 1%, reaching 6% within about 210 minutes at a bleed rate into the chamber of 0.5 l/m and within about 360 minutes at a bleed rate of 0.3 lm. These data demonstrate the kinetics of $CO_2$ absorption by the LiOH pads.

A human subject was then placed in the chamber and the $CO_2$ concentration was measured either with no $CO_2$ scrubber or with 14 pads of the $CO_2$ scrubber. Following this, a second human subject was placed in the chamber with either no $CO_2$ scrubbing pads or with 6 pads. In the experiment using 14 pads, the percent $CO_2$ remained essentially constant for 180 minutes at 0.5%, as compared to a rapid steady rise to about 4.0% in 60 minutes using no pads. In the experiment using 6 pads, the percent $CO_2$ rose slowly from about 0.5% to about 1.0% in about 15 minutes, reached about 2.0% after about 120 minutes, and about 3.0% after about 180 minutes, beginning to rise more steeply at about 150 minutes. The LiOH pads thus were shown to successfully prevent $CO_2$buildup in the chamber. On the average, and to a rough approximation, the usable lifetime per pad is approximately 20 minutes.

The third stage in the testing process involved measuring the oxygen consumption of a human subject as a function of time. These measurements were taken both with and without LiOH pads, but with no other regulation of gases. Oxygen was replaced by a pressure regulator attached to an oxygen gas cylinder. The pressure in the bag fell from 98 mmHg to 40 mmHg, both because of chamber leakage and because chamber air was bled out in order to measure the oxygen concentration. There was a dramatic and steady decrease of oxygen inside the chamber when no supplementation was available. The rate of decrease indicates that with or without the LiOH pads, the $O_2$concentration reaches dangerous levels (about 12%) within approximately two hours. (The experiment using no LiOH pads was terminated after 45 minutes.)

The final phase of testing involved combining a human subject, the pressurized chamber, the LiOH pads, and an $O_2$ supplementation system.

The chamber was inflated by means of a foot pump to 2 psi gauge. The $O_2$ regulator was then set to maintain the chamber at that pressure. With a completely leakproof chamber the only loss of pressure in the system is due to $O_2$ consumption by the subject, thus the $O_2$ regulator allows replacement of exactly that which has been used. Six hours was estimated to be the lifetime of the 136 liter $O_2$ bottle. The $CO_2$ and $O_2$ gas concentrations were measured as functions of time, and both curves are essentially flat, rising less than about 1%, over the entire six-hour duration of this experiment.

It has thus been shown that a leak-rate of 0.22 liter/-min. can be considered essentially air-tight. The LiOH pads successfully control the $CO_2$ concentration, and the $O_2$ bottle/regulator component successfully replaces the $O_2$ used by the subject while, at the same time, maintaining chamber pressure. The duration of treatment with no maintenance has been tested to six hours. This time period could be lengthened through use of an increased number of LiOH pads and larger or additional $O_2$ bottles as will be apparent to those skilled in the art.

It will be apparent that variations in materials, construction techniques, and pressure maintenance and control means are possible within the scope of ordinary skill in the relevant arts. Added refinements, including temperature and humidity control, lighting and electrical hook-ups may be included. Such refinements and modifications alone or in combination are deemed to fall within the scope of the claimed invention, being refinements or equivalents available to those of ordinary skill in the relevant arts.

DETAILED DESCRIPTION OF THE DRAWINGS

FIG. 1-A hyperbaric exerciser having an outer shell (1) of air permeable nylon fabric and an inner shell (2) of air-impermeable vinyl is shown. The inner shell (2) is sized slightly larger than the outer shell (1) so that pressure stress is primarily borne by the stronger outer shell (1). The inner shell (2) is constructed of individual panels joined along seams (15). An airtight zipper (4) in the inner shell provides means of ingress and egress. A flap panel (3) provides a means of ingress and egress through the outer shell. The flap panel (3) opens inwardly through the zipper (4) when the latter is unzipped. A frame (16) is constructed around the flap panel opening to provide a rigid structure for the flap panel (3) to rest against when shut and the exerciser is under pressure. An alternate viewing port (5) is provided. A platform (6) is supported by four legs (7) which extend through the outer and inner shells (1) and (2). The openings for the legs (7) are sealed by o-rings (8). The exerciser is pressurized by an air compressor (9) which delivers air into the exerciser. Excessive internal $CO_2$ and $H_2O$ are removed by a chemical scavenger (10), through which internal air is circulated by a small blower (11). An exit port (12) allows venting of excess pressure, optionally through a differential pressure valve (not shown). Oxygen content of internal air is replenished from a tank of compressed $O_2$ (13), whose flow rate is regulated by an inlet valve (14) in a panel of the exerciser. Optionally, the exerciser can be pressurized by substituting compressed air instead of $O_2$ in tank (13).

FIGS. 2, 3 and 4 show front, back and top views, respectively, of the exerciser drawn to reduced scale. Detachable components such as compressor pump or compressed gas tank are not shown in these views.

FIG. 5A

This is a representation of how one of the 18 panels is cut. All 18 panels are cut with the same pattern. The arcs are created by 30 short straight cuts. The distances from the center line to the arc for each of the numbered sections are given below:

| | |
|---|---|
| 1 2.9 cm | 9 17.8 cm |
| 2 5.1 cm | 10 19.1 cm |
| 3 7.2 cm | 11 20.1 cm |
| 4 9.3 cm | 12 20.9 cm |
| 5 11.3 cm | 13 21.4 cm |
| 6 13.1 cm | 14 21.8 cm |
| 7 14.9 cm | 15 21.9 cm |
| 8 16.4 cm | 16 21.9 cm |

The remaining 14 cuts are made symmetrically, taken in reverse order, omitting numbers 1 and 2. Each length is evenly spaced with a separation of 7.6 cm. The panel is symmetric in two dimensions so the remaining three arcs can be made from the same measurements. The bottom two sections (15.2 cm) are cut off to allow for a flat base. These dimensions are valid for a 2.45 meter (8 foot) diameter sphere.

FIG. 5B

Figure 5B:
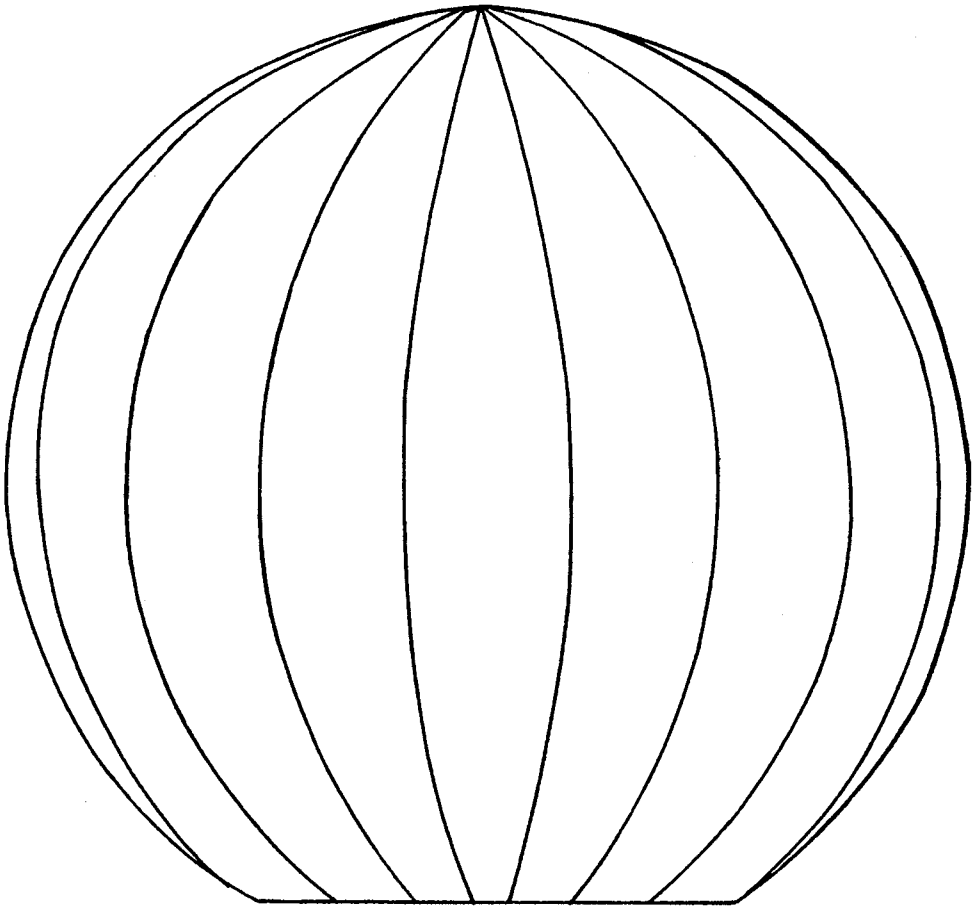
FIGS. 5*a*and 5*b* show a simplified side view of a hyperbaric exerciser (5*b*) showing component panels, and a representative panel (5*a*) with dimensions as set forth herein below.
Figure 5A:
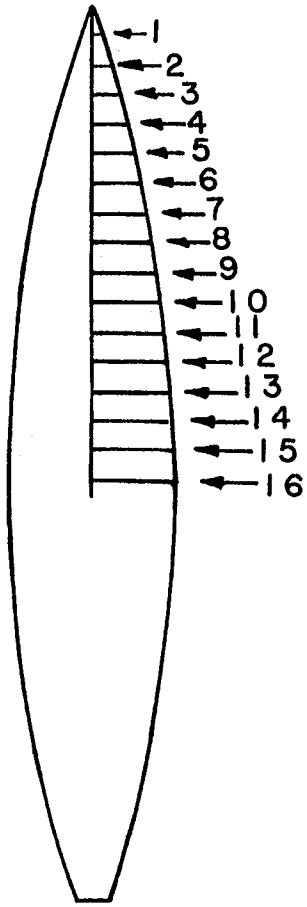

This is a schematic of the assembled "chamber." It is made from 18 panels cut with the pattern from FIG. 5A. Optionally, one or more panels may be made of clear or translucent material to improve lighting within. An air-tight zipper door is not shown. The diameter of the entire chamber is 2.44 meters or 8 feet. The base is a circular piece of vinyl with a diameter of 1.22 meters (4 feet).

The sphere was constructed by sewing together the panels shown in FIG. 1, using flat felled seams. Such seams are made by sewing together the panels to be joined face-to-face, then folding the free borders of the joined pieces under and top stitching to create an air-tight, stress-absorbing seam. All seams were formed in this manner, beginning in sequence from the panel adjacent to one side of the zipper tape, and proceeding to join each panel in turn, ultimately joining the last panel to the opposite side of the zipper tape. It is anticipated that radio-frequency welding, rather than sewing, will yield more air-tight seams. The floor was attached, beginning at the zipper tape, sewing around the sphere, easing the floor in by lining up corresponding floor and panel sections as the sewing proceeds around the perimeter of the base. After completing the sewing, all seams were treated with a paraffin wax-base solvent sealer to further reduce air leakage.

Figure 6:
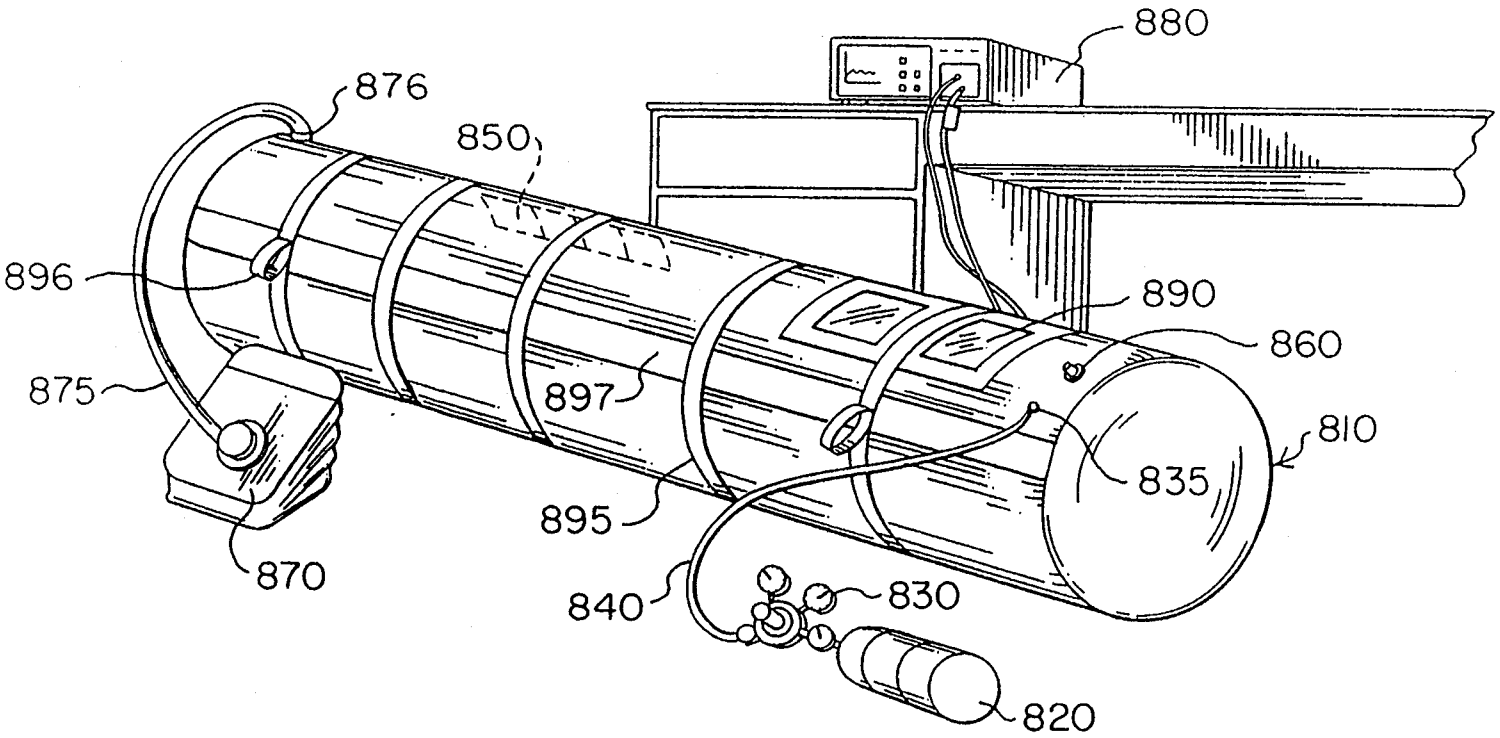
FIG. 6 is a diagram of the closed circuit rebreather of this invention using an oxygen supply source and a carbondioxide removal source.

FIG. 6 shows a preferred closed-circuit rebreather of this invention. The basic mountain bubble (810) is equipped with a canister of compressed oxygen (820) attached through a pressure regulator (830) to an inlet (835) into the chamber via an air hose (840). Lithium hydroxide pads (850) for absorbing carbon dioxide are shown in a cutaway view of the inside of the chamber. A pressure relief valve (860) which may be designed to automatically release pressure at a pre-selected pressure value is also provided. An optional foot pump (870) connected through an air hose (875) to an inlet (876) is also shown. If desired, a gas analyzer (880) may be attached to the bag to monitor oxygen and carbon dioxide content, as was done for the experiments described above to determine effectiveness of various parameters of the system. The chamber is equipped with clear vinyl windows (890) and reinforced with straps (895) equipped with handles (896). The longitudinal stripe (897) represents a heat-seal seam made during construction of the basic mountain bubble.

In operation, the chamber is pressurized as desired to a pre-selected value. This embodiment may be operated at atmospheric or ambient pressures as well as at hyperbaric pressures. A patient inside the chamber inhales air having a normal oxygen concentration of about 21%, and breathes out air in which some of the oxygen has been converted to carbon dioxide. The carbon dioxide is absorbed onto the lithium hydroxide pads 850, causing lowering of the pressure within the chamber. When the pressure is reduced below the pre-selected value to which the pressure regulator (830) has been set, oxygen is bled from the oxygen canister (820) into the chamber to replace the absorbed carbon dioxide. In this way, only the oxygen which has been converted to carbon dioxide in the patient's lungs is replaced. The oxygen bottle and lithium hydroxide pads may be replaced as necessary.

Figure 7:
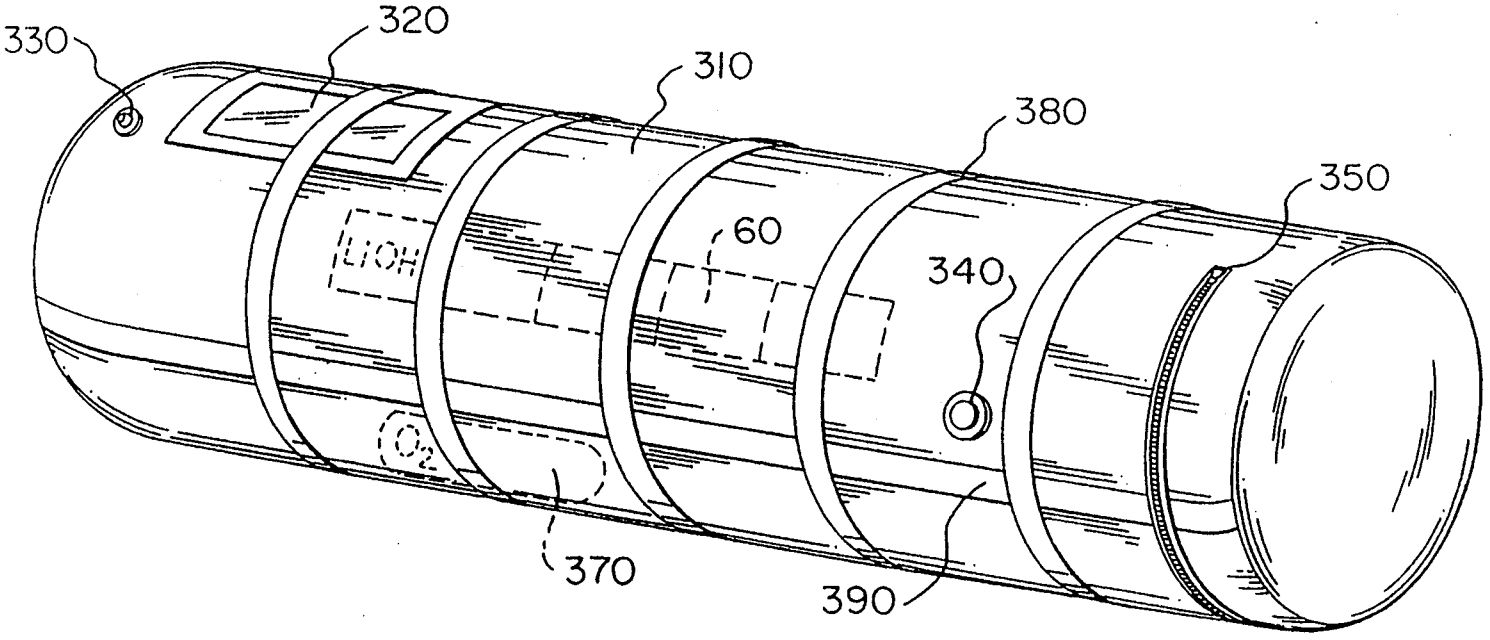
FIG. 7 shows the high-altitude habitat of this invention packed for carrying, including optional oxygen canister and lithium hydroxide carbon-dioxide scrubbers.

FIG. 7 shows the high-altitude habitat (310) of this invention, packed for carrying. When set up, the habitat is suitable for all purposes of a high-altitude mountain tent, allowing sufficient interior space for sleeping, dressing, eating and the like for one or two persons. The habitat is equipped with windows (320), an inlet valve (330) for pressurization via a pump (not shown), an outlet valve (340), which may be a pressure relief valve designed to release pressure at a pre-selected value such as 2 psi greater than ambient, and a zipper (350) for ingress and egress placed transversely, or at right angles to the long axis of the chamber for greater strength. Optionally, the high-altitude habitat may employ the closed-circuit breathing improvement of this invention, using lithium hydroxide pads (360) shown in cut-away view and an oxygen canister (370) also shown in cut-away view. Reinforcing straps (380) are provided. Stripe (390) indicates the heat-seal seam made during construction of the habitat.

In operation, the habitat is set up, using wands, poles or other rigid supports, to enclose a volume of unpressurized air. If pressurization is desired, the occupant enters the habitat, and it is pressurized through valve (330) using a pump or other source of air. The habitat is preferably equipped with oxygen (370) and lithium hydroxide carbon dioxide removal pads (360) sufficient to provide a period of several hours for sleeping without the necessity for pumping. The habitat may alternatively be equipped with a bladder arrangement as described above to allow a period during which no attention to maintaining a fresh air supply need be given.

FIG. 8 shows the zipper sleeve construction of this invention. One end of a sleeve (83) made of flexible, air-impermeable material, is attached to the inside of the chamber (84) by sewing or heat-sealing along a seam (82) around the inner perimeter of the zipper (81).

In operation, when the chamber is to be opened from the outside, the sleeve is pulled to the outside of the chamber to allow entry or exit from the chamber. The sleeve is then rolled or folded in inserted back inside the zipper opening when it is desired to close the chamber by zipping from the outside. For closing from the inside, the occupant of the chamber pulls the sleeve inside, closes the zipper by reaching inside the sleeve, and then rolls or folds the sleeve to prevent air loss through the sleeve.

Figure 9:
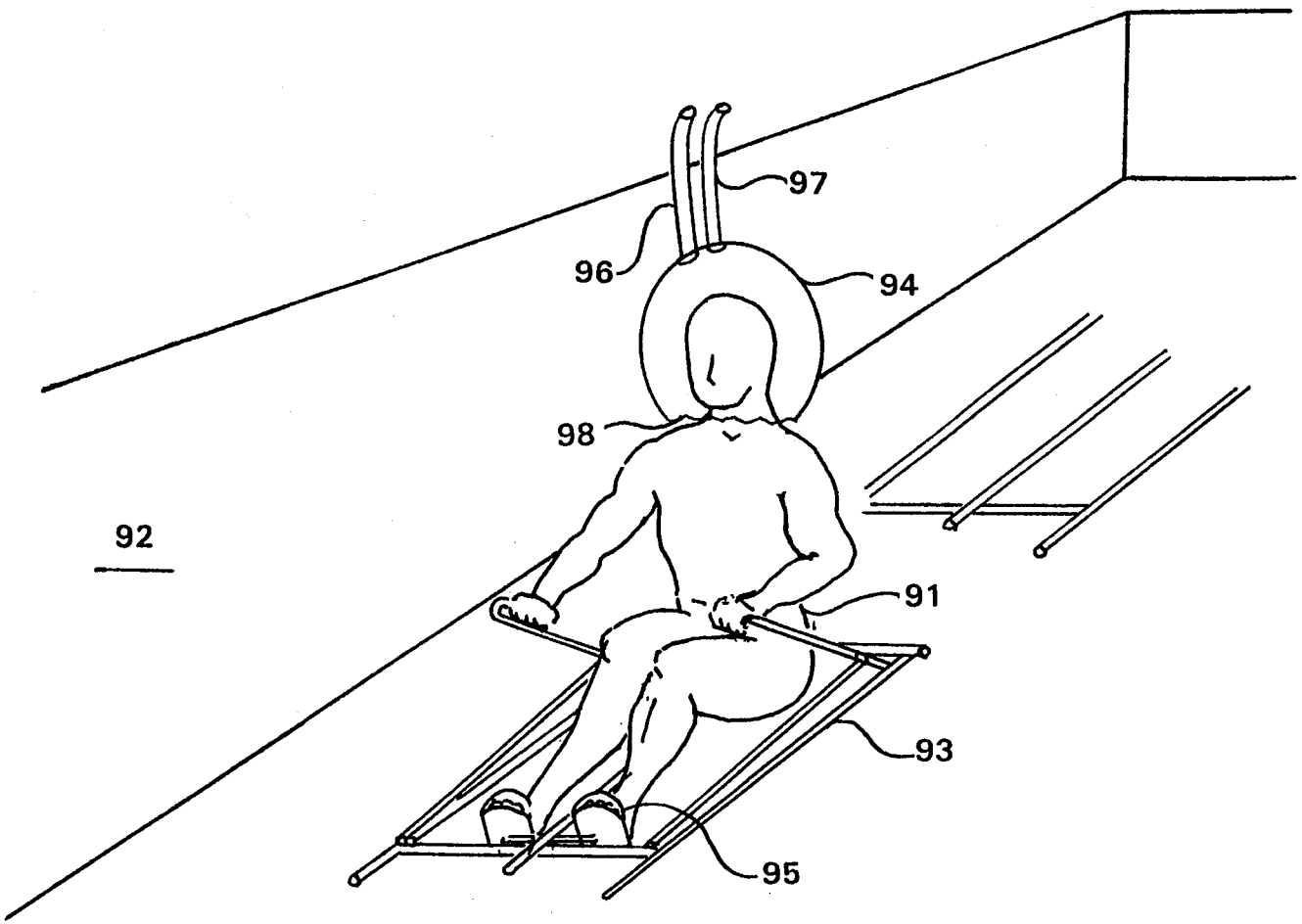
FIG. 9 shows the hydrobaric exercise environment of this invention.

FIG. 9 shows an embodiment of the hydrobaric exerciser of this invention. An exerciser (91) immersed in a swimming pool (92) is shown operating an underwater rowing machine (93) to which he is attached by straps (95) to prevent him from floating to the surface of the pool. The exerciser's head is inserted inside an air-filled transparent breathing bowl (94). The lower edge of the breathing bowl (94) is below the exerciser's nose and mouth so that his nose and mouth are above the air-water interface (98) of the bowl to allow breathing without a mask. Air is pumped into the bowl via an inlet line (96) and exits from the bowl through an outlet line (97).

In operation, the air pumped into the bowl is automatically pressurized by the water pressure on the bowl. Hand or electrical or motorized air pumping means may be used as is know to the art to supply uncontaminated air to the breathing bowl. Alternatively, air can be supplied from a pressurized reservoir such as that described in U.S. patent application Ser. No. 624,141, incorporated herein by reference. A constant supply of fresh air is preferably provided, and excess air is allowed to exit through outlet line (97). The exerciser thus breathes pressurized air while exercising, allowing him or her to achieve the health and fitness benefits of exercise in a shorter period of time than would be achievable at lower pressures.

The foregoing description is provided by way of illustration and not by way of limitation. It should be apparent that a number of modifications may be made by those skilled in the art to the embodiments depicted and described, all within the scope and spirit of the disclosure hereof, and such modifications are within the scope of this invention.

We claim:

1. A hyperbaric chamber having an internal capacity sufficient to permit an exerciser to perform exercise movements therein using stationary equipment, in the shape of sphere, semi-sphere or a truncated sphere, made of flexible, nonbreathable material, said chamber capable of maintaining air pressures in the range from about 0.2 to about 10 psi greater than ambient, means for achieving and adjusting air pressure inside the chamber adjustable from 0.2–10 pounds per square inch greater than ambient, and means for ingress and egress which can be closed to prevent air loss.

2. A hyperbaric chamber of claim 1 which is portable.

3. A portable hyperbaric chamber of claim 2 having an internal volume which is at least about 100 cu. ft.

4. A portable hyperbaric chamber of claim 2 wherein the air pressure is maintainable and adjustable from about 0.2 to about 4 psi greater than ambient.

* * * * *